US005164532A

United States Patent [19]

Ishii et al.

[11] Patent Number: 5,164,532

[45] Date of Patent: Nov. 17, 1992

[54] PERFORMANCE STATE DETECTING UNIT OF PLAYER PIANO SYSTEM

[75] Inventors: Jun Ishii; Mariko Takahashi, both of Hamamatsu, Japan

[73] Assignee: Yamaha Corporation, Hamamatsu, Japan

[21] Appl. No.: 770,621

[22] Filed: Oct. 3, 1991

[30] Foreign Application Priority Data

Nov. 1, 1990 [JP] Japan ..... 2-296992
Nov. 1, 1990 [JP] Japan ..... 2-296993
Nov. 1, 1990 [JP] Japan ..... 2-296994

[51] Int. Cl.[5] ..... G10H 1/32

[52] U.S. Cl. ..... 84/639; 84/724; 84/745; 84/21

[58] Field of Search ..... 84/626, 627, 639, 644, 84/658, 687, 718-720, 724, 737, 743-745, 20-22, DIG. 19, 7

[56] References Cited

U.S. PATENT DOCUMENTS

| | | | |
|---|---|---|---|
| 3,513,247 | 5/1970 | Anderson et al. | 84/724 |
| 3,558,793 | 1/1971 | Nakada et al. | 84/600 |
| 4,080,863 | 3/1978 | Groeschel | 84/658 |
| 4,351,221 | 9/1982 | Starnes et al. | 84/21 X |
| 4,790,230 | 12/1988 | Sanderson | 84/462 |
| 4,815,353 | 3/1989 | Christian | 84/724 |
| 5,012,715 | 5/1991 | Matsunaga et al. | 84/724 |

OTHER PUBLICATIONS

"Panasonic Electric Components"-pp. 358-361 Mar. 28, 1990.

"Semiconductor Data Book" by Sharp-pp. 788-789 & 792-793 Oct. 1989.

*Primary Examiner*—William M. Shoop, Jr.
*Assistant Examiner*—Brian Sircus
*Attorney, Agent, or Firm*—Spensley Horn Jubas & Lubitz

[57] ABSTRACT

The player piano provides a string-striking mechanism including a hammer driven by corresponding one of eighty-eight keys, and a photo sensor is provided in the vicinity of and also positioned to face with the predetermined member of this string-striking mechanism to be rotated responsive to a key-depression. This photo sensor outputs a signal which is varied in response to a distance of the predetermined member therefrom, so that the output thereof may have a peak value. Based on the peak value, first and second output values are respectively calculated, wherein these values corresponding to the predetermined two measuring points arranged between the photo sensor and the predetermined member are outputted from the photo sensor before and after the peak value respectively. On the basis of the distance between two measuring points and passing time to be passed when the sensor output is varied from the first output value to the second output value, a string-striking velocity of said string-striking mechanism representing a performance state of the play piano is to be computed. Thus, fixation and adjustment of the sensor can be made easily, thereby the string-striking velocity of the hammer can be sensed accurately.

7 Claims, 7 Drawing Sheets

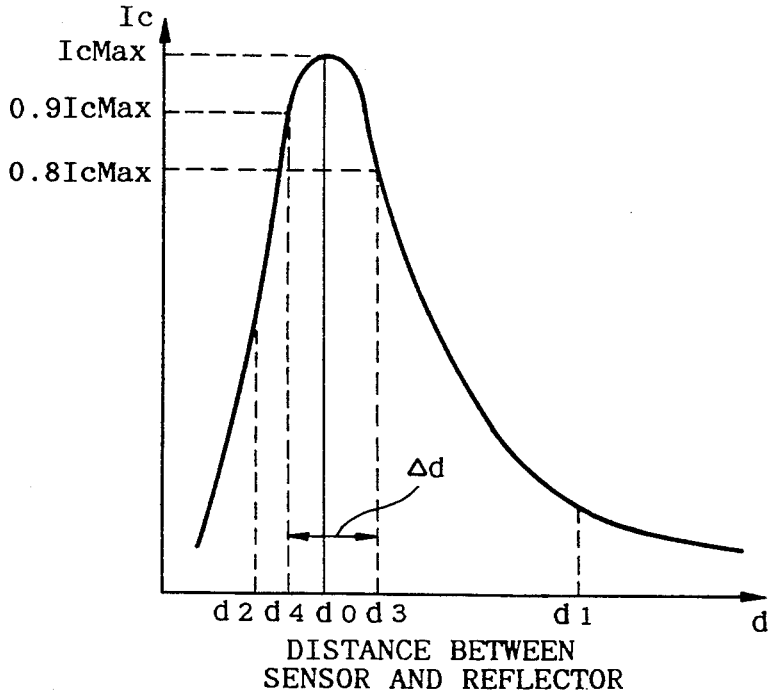
FIG.4 (DISTANCE CHARACTERISTIC OF PHOTO SENSOR 11)
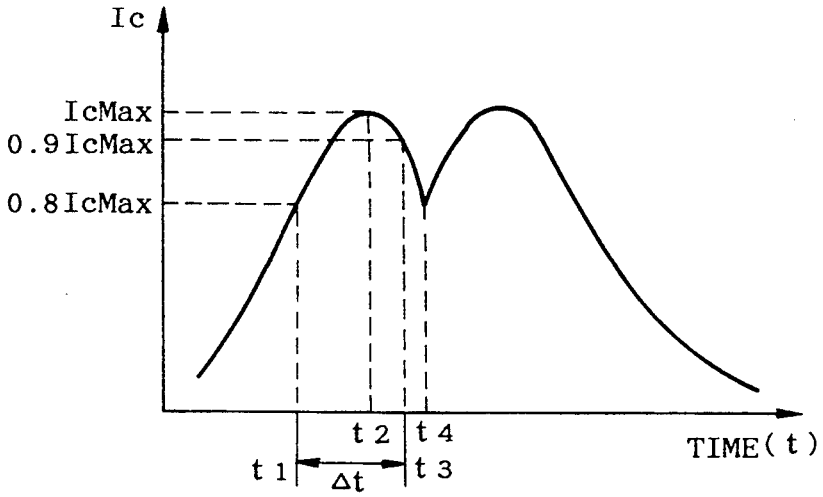
FIG.5 (OUTPUT CHARACTERISTIC OF PHOTO SENSOR 11)
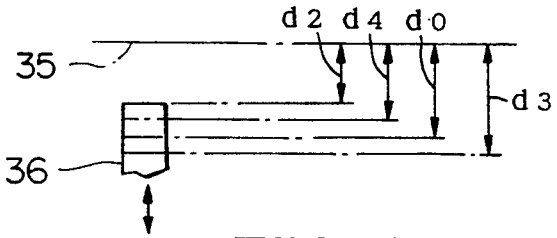
FIG.6

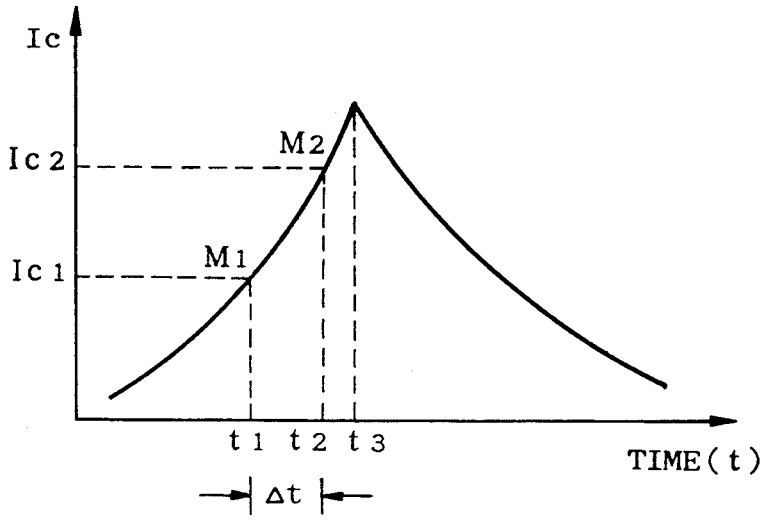
FIG.9 (OUTPUT CHARACTERISTIC OF PHOTO SENSOR 71)

PERFORMANCE STATE DETECTING UNIT OF PLAYER PIANO SYSTEM

BACKGROUND OF THE INVENTION

1. Field of the Invention

The present invention relates to a player piano system provided with a performance state detecting unit capable of detecting a string-striking velocity of a hammer with accuracy.

2. Prior Art

The player piano can record and then automatically playback the performance. Recording of the performance is made by use of a sensor which detects the string-striking velocity of the hammer corresponding to the depressed key. Based on such string-striking velocity to be detected, tone color and tone volume can be determined.

FIG. 1 illustrates an example of the conventional string-striking velocity detecting unit of the player piano.

In FIG. 1, this detecting unit provides a plate-shaped hammer shutter 94 at a middle portion of a hammer shank 93 of a hammer 92 which will strike a string 91.

Each of light-transmission-type photo sensors 95A, 95B is configured by a pair of light emitting portion and light receiving portion which are respectively placed to face each other. More specifically, these portions are positioned at both sides of the plane including a rotating locus of the hammer shutter 94. In addition, the photo sensor 95A is placed in the vicinity of another photo sensor 95B. For example, these sensors 95A, 95B are fixed, along with the rotating locus of the hammer shutter, to a fixing member 96 at respective positions which are apart from each other by the predetermined distance.

Thus, in the string-striking action of the hammer 92, the hammer shutter 94 can cut off each of the light paths of the photo sensors 95A, 95B.

Therefore, accompanied with the string-striking action of the hammer 92, the revolving hammer shutter 94 will cut off each of the light paths of the photo sensors 95A, 95B in turn. Then, this unit measures the time difference between light-cut-off times of the photo sensors 95A, 95B. Based on the measured time difference, this unit computes and then records the string-striking velocity of the hammer 91.

Actually, this unit detects the rotating velocity of the hammer shank at a time in the middle of the string-striking action. However, in order to accurately detect the actual string-striking velocity of the hammer 92, the photo sensors 95A, 95B must be placed close to the string-striking position of the hammer 92 as much as possible.

In order to improve the detection accuracy, it is necessary to accurately position the light emitting portion and light receiving portion of each photo sensor; accurately set the mechanical positionings of the photo sensors 95A, 95B and hammer shutter 94; and accurately set the distance between the photo sensors 95A, 95B.

According to the convetional string-striking velocity detecting unit of the player piano, a pair of photo sensors 95A, 95B must be provided for each of eighty-eight keys. However, it is difficult to arrange these photo sensors by the predetermined constant distance for each of eighty-eight keys. Due to the deviation of the distance between them, it is impossible to compute the string-striking velocity accurately even if the foregoing time difference is measured correctly.

Further, it is necessary to correct the distance between the sensors and fixing position of the sensor which may be deviated due to the dispersion among the hammers. In this case, however, it is difficult to correctly fix the hammer shutter to the hammer shank and set the positioning of the hammer shutter with respect to the sensor. Because, in order to attach the hammer shutter to the hammer shank, it is necessary to perform the task with high accuracy. This results in an increase in the manhours required for the assembly and adjustment.

In the conventional unit, it is impossible to arrange the photo sensor close to the string-striking point, because it is impossible to provide a space for adjusting the positioning of the sensor. As a result, the conventional unit can merely detect the average rotating velocity of the hammer, thus, it is impossible to detect the actual string-striking velocity with high accuracy. In other words, the actual string-striking point of each string must be differed with respect to each string-striking mechanism, however, the conventional unit cannot adjust the fixing position of the sensor close to such string-striking point.

In short, high-accuracy positioning is required for the sensor, however, in some cases, the detected string-striking velocity is not so correct due to the dispersion among the sensors. Therefore, the conventional unit must be improved with respect to the detection accuracy.

Microscopically, when the hammer strikes the string, the hammer felt partially cuts into the string and the string is slightly deflected due to the string-striking force imparted thereto. Therefore, it is very difficult to correctly specify the string-striking point.

In order to eliminate the above-mentioned drawback, it is necessary to develop the sensor which can follow up with the rotating action of the string-striking mechanism containing the hammer, in other words, which can output a signal responsive to the variation of the distance between the sensor and its corresponding member of the string-striking mechanism. As this sensor, it is possible to adopt the so-called reflection-type photo sensor, for example.

This photo sensor is designed to output a signal of which value can be varied responsive to the variation of the distance between the sensor and member of the string-striking mechanism. This sensor provides with first and second outputs with respect to two measuring points of the member, wherein each of two measuring points has a different distance against the sensor. Based on these outputs, rotating time of the member which passes between two measuring points is measured. On the basis of the measured time and distance between two measuring points, it is possible to compute the string-striking velocity of the hammer.

However, each photo sensor may have a different output characteristic corresponding to the variation of the distance because of the different reflection rate of the light-reflecting-surface of the member and different fixing position of each photo sensor. This will cause a dispersion among the computation results of the string-striking velocity corresponding to the outputs of the sensors. For this reason, it is necessary to make a correction with respect to the dispersion among the string-striking velocities detected by respective photo sensors.

SUMMARY OF THE INVENTION

It is accordingly a primary object of the present invention to provide a performance state detecting unit of player piano system in which fixation and adjustment of the sensor can be made easily, thereby sensing the accurate string-striking velocity of the hammer.

In a first aspect of the present invention, there is provided a performance state detecting unit of a player piano system comprising:

detection means which is positioned in the vicinity of and also positioned to face with a predetermined member of a string-striking mechanism to be rotated responsive to a key-depression in a player piano, the detection means outputting a signal which is varied in response to a distance between the predetermined member and detection means with respect to a peak value;

calculating means for calculating first and second output values respectively based on the peak value of an output signal of the detection means, wherein the first and second output values respectively corresponding to two predetermined measuring points arranged within the distance are outputted from the detection means before and after the peak value respectively;

measuring means for measuring a passing time to be passed when the output signal of the detection means is varied from the first output value to the second output value; and string-striking velocity computing means for computing a string-striking velocity of the string-striking mechanism based on the passing time and a distance between the two measuring points.

In a second aspect of the present invention, there is provided a performance state detecting unit of a player piano system comprising:

detection means which is positioned in the vicinity of and also positioned to face with a predetermined member of a string-striking mechanism to be rotated responsive to a key-depression in a player piano, the detection means outputting a signal which is varied in response to a distance between the predetermined member and detection means;

calculating means for calculating first and second output values respectively based on a reference value of an output signal of the detection means;

distance setting means for setting a distance between two measuring points respectively corresponding to the first and second output values with respect to the reference value;

measuring means for measuring a passing time to be passed when the output signal of the detection means is varied from the first output value to the second output value; and string-striking velocity computing means for computing a string-striking velocity of the string-striking mechanism based on the passing time and distance between the two measuring points.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings:

FIG. 4 is a graph showing a relationship between the distance of light reflecting surface and output of the photo sensor used in the first embodiment;

FIG. 5 is a graph showing an output characteristic of the photo sensor used in the first embodiment;

FIG. 6 is a drawing conceptually showing a variation of the distance between the photo sensor and wood end of catcher in the first embodiment;

FIG. 9 is a graph showing an output characteristic of the photo sensor used in the second embodiment.

DESCRIPTION OF THE PREFERRED EMBODIMENTS

[A] First Embodiment

Figure 1:
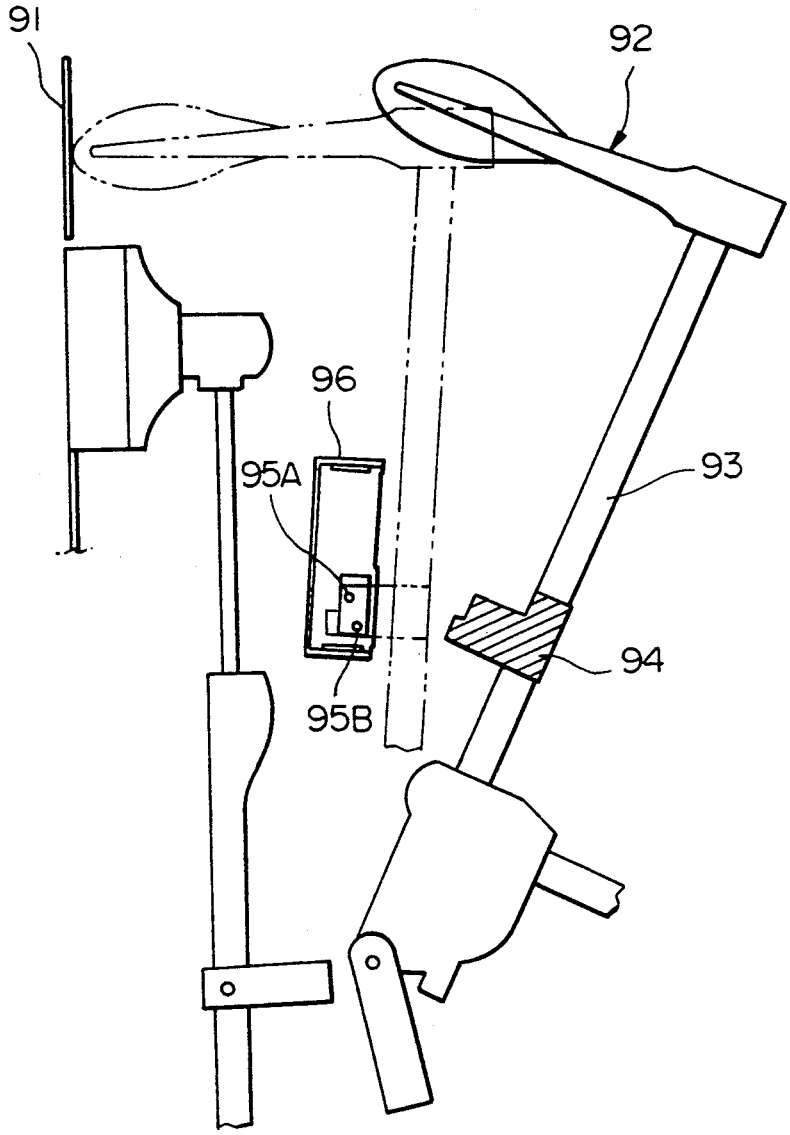
FIG. 1 (PRIOR ART)
FIG. 1 is a side view illustrating an example of the conventional string-striking velocity detecting unit.
Figure 2:
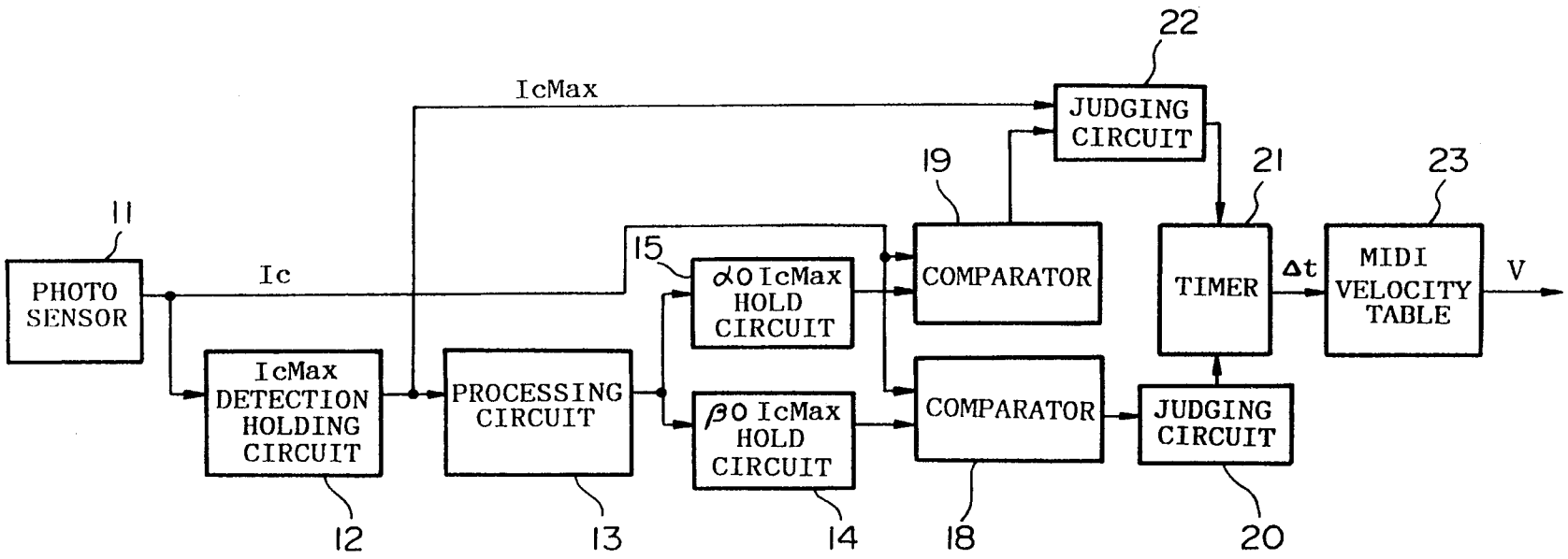
FIG. 2 is a block diagram showing a circuit configuration of a performance state detecting unit of a player piano according to a first embodiment of the present invention.

Next, description will be given with respect to the preferred embodiments of the present invention, wherein FIG. 2 is a block diagram showing a performance state detecting unit (i.e., string-striking velocity detecting unit) of a player piano according to the first embodiment of the present invention.

Figure 3:
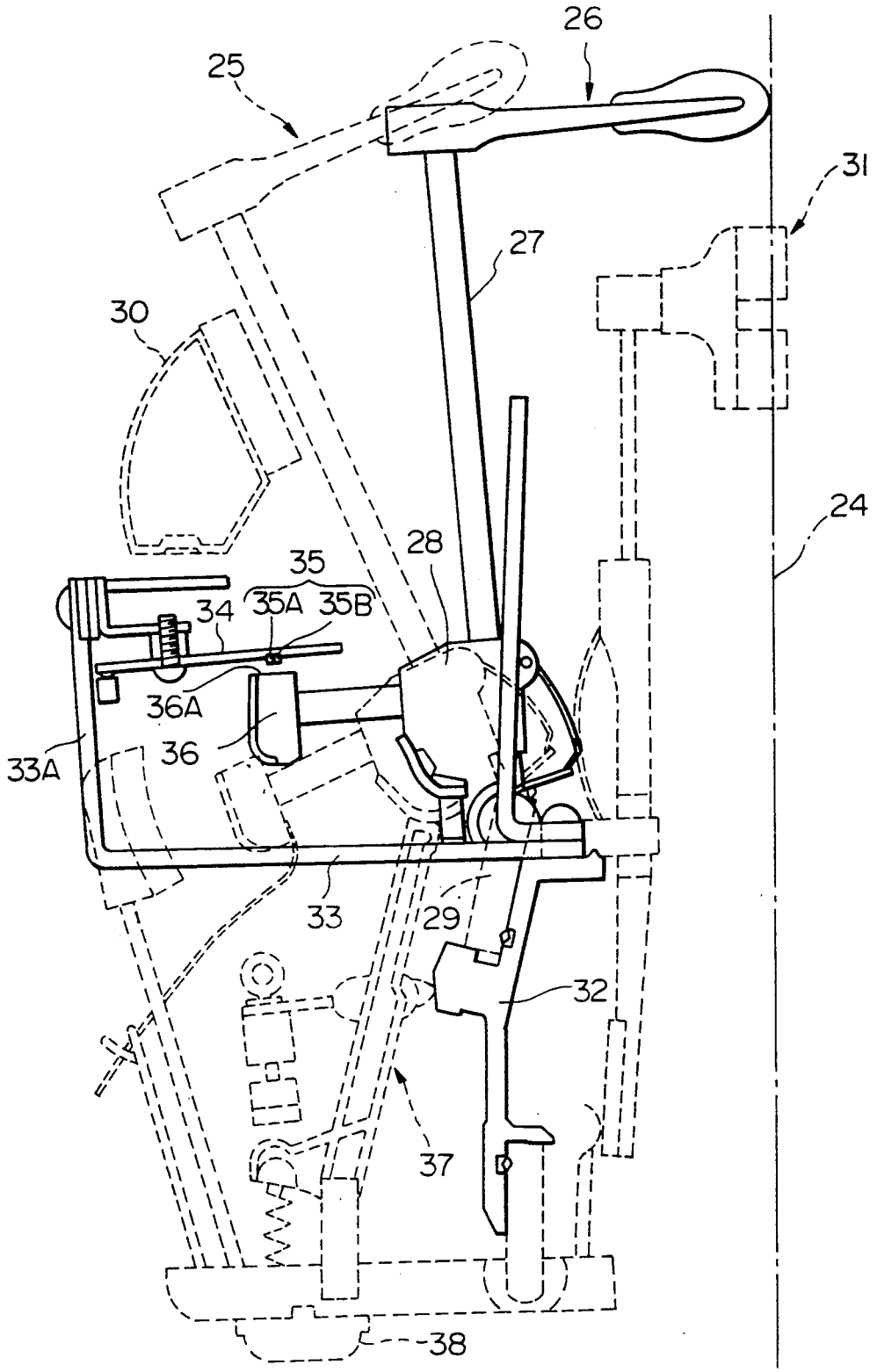
FIG. 3 is a side view illustrating a string-striking mechanism of the first embodiment.

FIG. 3 is a side view illustrating a string-striking mechanism of this player piano.

As shown in FIG. 2, this unit provides a reflection-type photo sensor 11 which radiates light toward its corresponding member in the string-striking mechanism to thereby output current Ic, wherein this current Ic is varied responsive to the luminosity of the reflected light. This photo sensor 11 is set such that the current Ic reaches the peak value IcMax during the string-striking action. More specifically, setting is made for the distance between the sensor and member, focal length of the light-receiving lens of the photo sensor 11 and the like.

The output current Ic of the photo sensor 11 is supplied to an IcMax detection holding circuit 12 which detects and then holds the peak value IcMax of the current Ic. The peak value IcMax outputted from the detection holding circuit 12 is processed in a processing circuit 13. Thus, the processing circuit 13 outputs a first output value "$\beta$0*IcMax", for instance, "0.8*IcMax", and a second output value "$\alpha$0*IcMax", for instance, "0.9*IcMax", to hold circuits 14, 15 respectively.

Meanwhile, the foregoing output current Ic of the photo sensor 11 is also supplied to comparators 18, 19. The comparator 18 compares Ic to the first output value 0.8IcMax, while another comparator 19 compares Ic to the second output value 0.9IcMax.

Then, a judging circuit 20 judges the contents of the comparison result of the comparator 18. When the output Ic of the photo sensor 11 exceeds the first output value 0.8IcMax before it reaches the peak value IcMax, this judging circuit 20 outputs a trigger signal by which a timer 21 is started.

On the other hand, another judging circuit 22 judges the contents of the comparison result of the comparator 19. When the output Ic of the photo sensor 11 is further varied to become smaller than the second output value 0.9IcMax after it reaches the peak value IcMax, the judging circuit 22 outputs a stop signal to stop the timer 21.

The timer 21 counts number of pulses to thereby measure the passing time between the start timing and stop timing thereof. Thus, the timer 21 outputs a timer signal Δt corresponding to the passing time. This timer signal Δt is converted into velocity information of MIDI (i.e., Musical Instruments Digital Interface) signal by a MIDI velocity table 23, thereby obtaining a string-striking force V applied by the string-striking mechanism.

As illustrated in FIG. 3, an action mechanism (i.e., string-striking mechanism) 25 which will strike a string 24 provided in vertical direction is provided corresponding to each of eighty-eight keys.

This action mechanism 25 is constructed by several members as described below.

The action mechanism 25 contains a hammer 26 which strikes the string 24, a hammer shank 27 interconnected with this hammer 26, a butt 28 fixed at a base edge portion of this hammer shank 27, a butt flange 29, a hammer rail 30 and the like. Herein, the hammer shank 27 and butt 28 are supported by the butt flange 29 such that they can freely swing about a center pin which works as a fulcrum of the swing motion. In addition, the hammer rail 30 regulates the distance between the hammer shank 27 and string 24.

Further, there is provided a damper 31 between the string 24 and action mechanism 25 and in the vicinity of the string 24. The damper 31 is operated in connection with the operation of the action mechanism 25. When stepping on the damper pedal (not shown), the damper 31 is departed from the string 24, so that vibration of the string 24 can be continued.

Furthermore, 32 designates a center rail which fixes and supports the above-mentioned butt flange 29 and the like.

At the upper edge portion of the center rail 32, a bracket 33 is provided in a horizontal direction departing from the string 24. In addition, a back edge portion 33A of the bracket 33, which is positioned apart from the string 24, is folded up. At an upper edge of the folded portion 33A, a substrate 34 is fixed in horizontal direction.

On this substrate 34, there is provided the foregoing circuits 12–23 and a reflection-type photo sensor 35 (i.e., photo sensor 11). Herein, this reflection-type photo sensor 35 is configured by a light emitting portion 35A capable of emitting light downward and a light receiving portion 35B capable of receiving the reflected light.

This photo sensor 35 is arranged to face with a catcher which is projected from a back side portion of the butt 28. In the string-striking operation of the hammer 26, a wood end 36A of the catcher 36 is rotated from a position illustrated by a dotted line to another position illustrated by a solid line, so that it is moved to face with the photo sensor 35 by the predetermined gap. The catcher 36 is one of the members of the string-striking mechanism 25. Therefore, the photo sensor 35 is arranged in the vicinity of and to face with the member of the string-striking mechanism 25.

Incidentally, in FIG. 3, 37 designates a jack and 38 designates a wipen.

In the photo sensor 35, the light emitting portion 35A having a light emitting element (e.g., LED) and a light emitting lens is designed to radiate the light in downward direction, while the light receiving portion 35B having a light receiving element (e.g., photo diode) and a light receiving lens is designed to receive the light reflected by the reflection surface. In response to the quantity (or luminosity) of the reflected light received by the light receiving portion 35B, the output current Ic of the photo sensor 35 is varied.

In the string-striking action of the action mechanism 25, the catcher 36 is rotated with the butt 28, hammer 26 etc., which varies the distance d between the wood end 36A of the catcher 36 and photo sensor 35. In response to such distance variation, quantity of the reflected light received by the light receiving portion 35B of the photo sensor 35 is to be varied.

As shown in FIG. 4, the output Ic of the photo sensor 35 is varied with respect to the above-mentioned variation of the distance d.

As shown in this graph, the output Ic becomes smaller as the distance between the wood end 36A of the catcher 36 and photo sensor 35 becomes larger. For example, when the wood end 36A is positioned far from the photo sensor 35 (e.g., distance is at "d1"), the output Ic is relatively small. Then, as the wood end 36A approaches closer toward the photo sensor 35, in other words, as the distance is varied from d1 to d3, the output Ic becomes higher. When the wood end 36A reaches at the constant distance d0, the output of the photo sensor 35 reaches the peak value (i.e., maximum value) IcMax. Thereafter, when the wood end 36A approaches further closer toward the photo sensor 35, in other words, when the distance is further varied from d0 to d2, the output Ic becomes smaller than the peak value IcMax. Incidentally, the abovementioned constant distance d0 is set under consideration of the directional characteristic of the light emitting portion 35A and light receiving portion 35B.

Therefore, the distance (i.e., d1–d2) between the wood end 36A of the catcher 36 and photo sensor 35 is set such that the output Ic is varied within the predetermined range containing the peak value IcMax. In other words, the photo sensor 35 is placed at the position at which the peak value IcMax is obtained during the period of the string-striking action when the catcher 36 is rotated within the movable range (d1–d2).

The graph shown in FIG. 5 indicates the variation of the output signal Ic of the photo sensor 35 in the string-striking action. In this string-striking action, as shown in FIG. 4, the distance between the photo sensor 35 and its reflection surface (i.e., wood end 36A) is varied as d1, d0 (corresponding to the peak value), d2 (corresponding to the string-striking point), d0, d1 in turns.

More specifically, in the string-striking action wherein the hammer 26 is rotated toward the string 24, the catcher 36 is rotated with the hammer 26, so that the wood end 36A approaches closer toward the photo sensor 35. In this approach, 80% of the peak value IcMax (i.e., foregoing first output value) is obtained at time t1. At this time t1 corresponding to the first output value, the distance between the sensor and catcher is at d3.

Next, the catcher 36 is further rotated toward the photo sensor 35, so that the peak value IcMax is obtained at time t2, wherein the distance between the sensor and catcher is at d0. In next time t3, 90% of the peak value IcMax (i.e., foregoing second output value) is obtained, wherein the distance between the sensor and catcher is at d4.

At time t4, the hammer 26 strikes the string 24 so that the string-striking point is formed, wherein the distance between the sensor and catcher is at d2. From this time on, the action mechanism 25 including the hammer 26 is rebounded from the string 24. Theoretically, the output of the sensor 35 is varied in symmetrical manner with respect to the string-striking point t4. In some cases, however, variation manner of the sensor output is not varied symmetrically because of the difference of the key-release timing.

FIG. 6 conceptually shows the variation manner of the distance d between the wood end 36A of the catcher 36 and photo sensor 35.

As shown in FIG. 6, at the string-striking timing, the wood end 36A approaches closet toward the photo sensor 35, so that the distance therebetween is at d2. On the other hand, when the sensor output reaches the peak value, their distance is at d0. In addition, the distance between the wood end 36A and photo sensor 35 is at d3 when the first output value 0.8IcMax is obtained, while it is at d4 when the second output value 0.9IcMax is obtained.

Therefore, in the player piano, at the first automatic string-striking action (which is made by driving the actuator such as the solenoid), the detection hold circuit 12 memorizes the maximum sensor output (i.e., peak value IcMax) with respect to each photo sensor 11 (or 35). Then, the processing circuit 13 calculates the first output value 0.8IcMax and second output value 0.9IcMax.

Then, the calculated first and second output values are held by the hold circuits 14, 15 respectively.

The outputs of the hold circuits 14, 15 are respectively supplied to the comparators 18, 19 as the reference value.

Next, when recording the performance, the action mechanism 25 is rotated in response to the key-depression, so that the photo sensor 35 outputs a signal Ic which is varied in a lapse of time along with the curve as shown in FIG. 5 and the like.

Then, the comparator 18 judges whether or not the sensor output signal Ic reaches the first output value. At time t1 when the judging circuit 20 judges that the sensor output Ic coincides with the first output value before it reaches the peak value IcMax, the timer 21 starts to measure the passing time.

Next, when the sensor output coincides with the second output value after it reaches the peak value IcMax, the judging circuit 22 outputs the stop signal to the timer 21. As a result, the timer 21 stop measuring the passing time.

This measure, passing time t is outputted from the timer 21 to the MIDI velocity table 23, from which the string-striking force V is obtained.

Incidentally, if the sensor output passes the peak value but it does not reaches the string-striking value, it is judged that no string-striking operation is made.

Due to the dispersion of the fixing position of each photo sensor 35 and another dispersion of the light reflection rate of the wood end 36A of the catcher 36, the sensor output Ic may have a waveform which is different from that of the present embodiment.

As described before, at time t1, the catcher 36 passes through the first measurement point corresponding to 80% output which is obtained by normalizing (or standardizing) the peak value IcMax of each photo sensor 35, while at time t3, the catcher 36 passes through the second measurement point corresponding to 90% output of the peak value after the sensor output reaches the peak value. The present embodiment is designed to measure the passing time Δt between the above-mentioned times t1, t3. As a result, it is possible to correctly detect the string-striking velocity of the hammer 26.

Figure 7A:
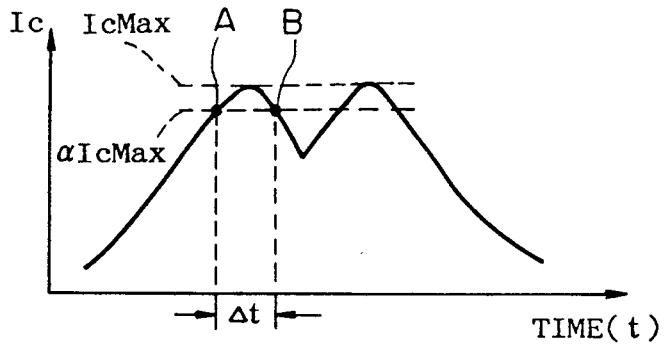
FIGS. 7A to 7C are graphs each showing an output characteristic of the photo sensor using another example of the output values.

FIG. 7A shows another example of the first and second output values to be set in the present embodiment.

As shown in FIG. 7A, two measuring points A, B can be represented as $\alpha\%$ of the peak value IcMax. In this case, time Δt by which the catcher 36 moves between two measuring points is measured by use of the first and second output values each represented as "$\alpha$IcMax".

Figure 7B:
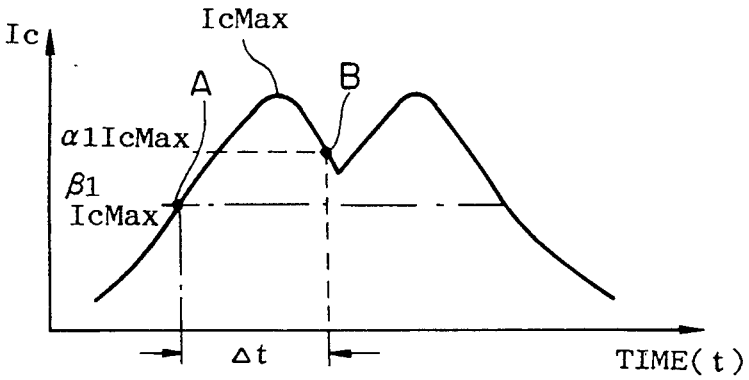
Figure 7C:
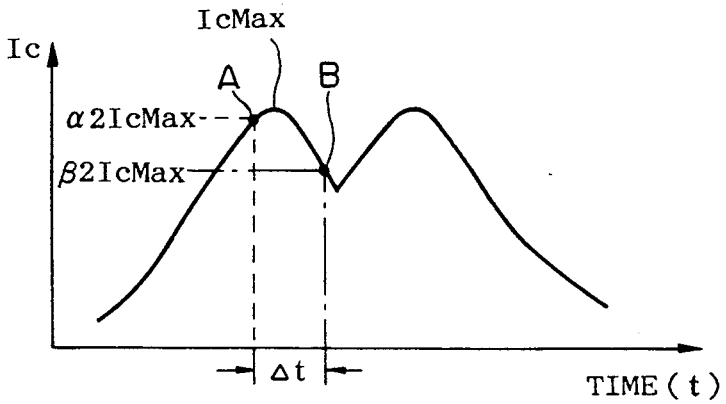

Further, two measuring points can be represented as the arbitrary values to be calculated by use of the peak value IcMax. For example, two measuring points A, B can be represented as $\alpha 1\%$, $\beta 1\%$ of the peak value IcMax as shown in FIG. 7B, or they can be represented as $\alpha 2\%$, $\beta 2\%$ of the peak value IcMax as shown in FIG. 7C.

As described heretofore, by adequately setting the first and second output values, it is possible to detect the rotating velocity of the hammer 26 just before the actual string-striking point with high accuracy.

[B] Second Embodiment

Figure 8:
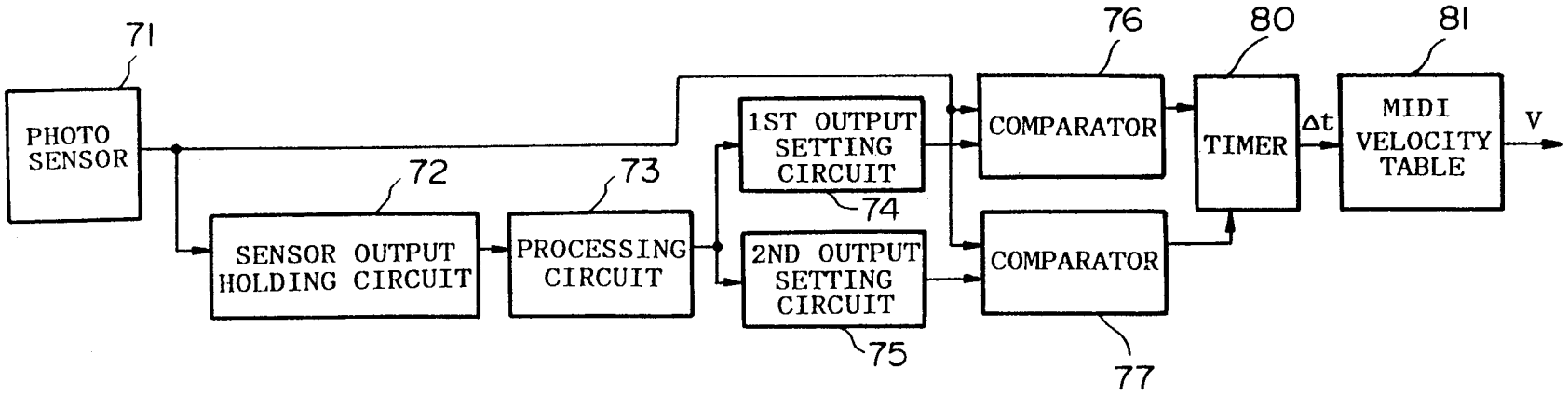
FIG. 8 is a block diagram showing a circuit configuration of the performance state detecting unit according to a second embodiment of the present invention.

FIGS. 8, 9 show the second embodiment of the present invention.

This embodiment provides another applied example of the present invention, i.e., another string-striking velocity detecting unit which can be operated even if the sensor output does not have the peak value, in other words, the sensor output is increased or decreased monotonously.

FIG. 8 shows the circuit configuration of this string-striking velocity detecting unit, while FIG. 9 shows a graph indicating the output characteristic of the photo sensor.

In this embodiment, as shown in FIG. 9, the output Ic of the photo sensor 71 does not have the peak value during the string-striking action and it is monotonously increased in response to the varying distance between the wood end 36A of the catcher 36 and photo sensor 71.

In the monotonous increasing portion of the output Ic, the passing time is measured between two output values Ic1, Ic2 to be arbitrarily set. In other words, the time Δt between the corresponding measuring points M1, M2 is measured, by which the string-striking force V is detected. These measuring points M1, M2 can be determined by adequately making a computation corresponding to the increasing rate of the output Ic.

As shown in FIG. 8, the output of the photo sensor 71 is held in a sensor output holding circuit 72. Then, a processing circuit 73 computes first and second output values Ic1, Ic2 based on output MO corresponding to the string-striking point, for example.

The computed first and second output values are respectively passed through first and second output setting circuits 74, 75 and then supplied to comparators 76, 77 as the reference values. These comparators 76, 77 compare the output of the photo sensor 71 with their reference values respectively.

When the output of the photo sensor 71 is varied between the first and second output values Ic1, Ic2, a timer 80 is started and then stopped under operations of the comparators 76, 77. Thus, passing time Δt between two measuring points M1, M2 is measured.

This passing time Δt to be measured is supplied to a MIDI velocity table 81 wherein it is converted into the actual string-striking force V of the hammer.

Incidentally, computation and memorization of each output value in each embodiment can be made by use of the known logical operation circuit such as the microprocessor.

In the foregoing first and second embodiments, the reflection-type photo sensor is used. However, such sensor can be embodied by another known sensor capable of outputting a signal which is varied in response to the distance variation as shown in FIG. 4. For example, it can be embodied by the ultrasonic sensor, magnetic sensor and the like.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A performance state detecting unit of a player piano system comprising:

detection means positioned to face towards a predetermined member of a string-striking mechanism which is rotated responsive to a key-depression of a player piano key, said detection means also being positioned in the vicinity of a string-striking position of the predetermined member, said detection means outputting a signal which is varied in response to a distance between said predetermined member and said detection means with respect to a peak signal value;

calculating means for calculating first and second output values, respectively based on said peak signal value, of an output signal of said detection means, wherein said first and second output values are output from said detection means before and after said peak signal value, respectively, said first and second output values respectively corresponding to first and second measuring points, the first measuring point being located at a first position which is before a peak position at which the peak signal value is produced and the second measuring point being located after the peak position with respect to a direction of travel of the string-striking mechanism toward the string;

measuring means for measuring a length of time from said first output value to said second output value; and string-striking velocity computing means for computing a string-striking velocity of said string-striking mechanism based on said length of time and a distance between said first and second measuring points.

2. A performance state detecting unit of a player piano system as defined in claim 1 wherein said detection means is a photo sensor which senses a luminosity of light which is radiated from the photo sensor and reflected by said predetermined member so as to output a signal corresponding to said distance between said detection means and said predetermined member.

3. A performance state detecting unit of a player piano system as defined in claim 2 wherein said predetermined member includes a catcher projected from a butt fixed at a base edge of a hammer shank interconnecting with a hammer, so that light radiation from the photo sensor is reflected by an end of said catcher.

4. A performance state detecting unit of a player piano system as defined in claim 1 wherein said detection means is adjusted such that the position said peak signal value is obtained is at least one of just before and just after a string-striking timing at which a hammer strikes a string of the player piano.

5. A performance state detecting unit of a player piano system according to claim 1, wherein the first measuring point is located a predetermined distance from the peak position and the second measuring point is located closely adjacent to the string-striking position of the predetermined member.

6. A performance state detecting unit of a player piano system according to claim 1, wherein the first measuring point is located a greater distance from the peak position than the second measuring point.

7. A performance state detecting unit of a player piano system comprising:

detection means which is positioned in the vicinity of and also positioned to face towards a predetermined member of a string-striking mechanism which is rotated responsive to a key-depression of a player piano key, said detection means outputting a signal which is varied in response to a distance between said predetermined member and said detection means with respect to a peak signal value, said detection means including a photo sensor which senses a luminosity of light which is radiated from the photo sensor and reflected by said predetermined member so as to output a signal corresponding to said distance between said detection means and said predetermined member;

calculating means for calculating first and second output values, respectively based on said peak signal value, of an output signal of said detection means, wherein said first and second output values are output from said detection means before and after said peak signal value, respectively, said first and second output values respectively corresponding to first and second measuring points arranged a predetermined distance from said detecting means;

measuring means for measuring a length of time from said first output value to said second output value; and string-striking velocity computing means for computing a string-striking velocity of said string-striking mechanism based on said length of time and a distance between said first and second measuring points, wherein said predetermined member includes a catcher projected from a butt fixed at a base edge of a hammer shank interconnecting with a hammer, so that light radiation from the photo sensor is reflected by an end of said catcher.

* * * * *